US005923940A

United States Patent [19]

Baldwin et al.

[11] Patent Number: 5,923,940

[45] Date of Patent: Jul. 13, 1999

[54] CLEANING BRUSH HAVING FIBERS OF DIFFERENT LENGTHS

[75] Inventors: Steven W. Baldwin, Fairport; Dennis G. Gerbasi, Webster; Thomas A. Prentiss, Fairport; David R. Stookey, Rochester; Bruce E. Thayer, Webster; Ralph J. Weber, Fairport; Matthew P. Daniels, Rochester; James J. Teich, Penfield; Moritz P. Wagner, Walworth, all of N.Y.

[73] Assignee: Xerox Corporation, Stamford, Conn.

[21] Appl. No.: 08/899,741

[22] Filed: Jul. 24, 1997

[51] Int. Cl.[6] ..... G03G 21/00

[52] U.S. Cl. ..... 399/353; 15/1.51; 15/256.5; 399/354

[58] Field of Search ..... 399/98, 99, 123, 399/353, 343; 15/256.5, 256.6, 1.51

[56] References Cited

U.S. PATENT DOCUMENTS

| | | | |
|---|---|---|---|
| 4,361,922 | 12/1982 | Karak | 399/353 |
| 4,706,320 | 11/1987 | Swift | 15/1.51 |
| 5,354,607 | 10/1994 | Swift et al. | 428/294 |
| 5,357,328 | 10/1994 | Lundy | 399/353 |

FOREIGN PATENT DOCUMENTS

| | | |
|---|---|---|
| 4-195080 | 7/1992 | Japan . |
| 7-013405 | 1/1995 | Japan . |

*Primary Examiner*—Arthur T. Grimley
*Assistant Examiner*—Quana Grainger

[57] ABSTRACT

An apparatus and printing machine that contain a cleaner brush with long sweeper fibers orientated along the overall width of the brush, and having a greater length than the majority of fibers of the brush to remove the particles that adhere to the cleaner housing and thus, prevent toner droppings.

8 Claims, 2 Drawing Sheets

CLEANING BRUSH HAVING FIBERS OF DIFFERENT LENGTHS

BACKGROUND OF THE INVENTION

This invention relates generally to an electrostatographic printer and copier, and more particularly, to a cleaning brush containing long sweeper fibers to prevent toner droppings from surfaces such as the cleaner housing with little increase in toner emissions.

Photoreceptor cleaning brushes are usually located inside cleaner housings. The gap between the inner wall of the housing and the tips of the brush fibers is usually less than 1 mm. As untransferred toner on the photoreceptor surface is collected by the brush, very often, it is deposited onto the housing wall. When this build up is sufficiently high, toner particles detach from the wall and emissions and toner droppings from the cleaner housing are created causing contamination around the cleaner and on the photoreceptor surface. Elimination of the toner build up on the inner wall of the housing would prevent toner accumulation.

The following disclosures may be relevant to various aspects of the present invention and may be briefly summarized as follows:

U.S. Pat. No. 5,354,607 to Swift et al. discloses a static eliminator device that includes a nonmetallic pultruded composite member having a plurality of conductive carbon fibers provided within a polymer matrix of thermosetting resin, wherein the plurality of carbon fibers are oriented within the polymer matrix in a longitudinal direction of the pultruded composite member and extend continuously therethrough. The pultruded composite member has at least one laser fibrillated end including a brush-like structure of densely distributed filament contacts formed from an exposed length of the carbon fibers for contact with the surface. The brush-like structure has either a straight edge configuration or a shaped configuration. The static eliminator device may include a base member for holding the pultruded composite member, wherein the base member electrically communicates with the plurality of conductive fibers to permit the electrical charge to pass therefrom. The static eliminator device utilizes a plurality of the pultruded composite members attached to the base member, each having a rod shape, or a single pultruded composite member having a planar shape. Alternatively, the static eliminator device may essentially be of single piece construction, wherein the pultruded composite member is planar in shape.

SUMMARY OF INVENTION

Briefly stated, and in accordance with one aspect of the present invention, there is provided an apparatus for cleaning particles from an imaging surface comprising: a housing having an interior surface wall; and a cleaning brush at least partially enclosed in the housing, the cleaning brush including a core having fibers extending outwardly therefrom, the fibers having a first fiber length and a second fiber length about the core.

Pursuant to another aspect of the present invention, there is provided an electrostatographic printing machine comprising: a charge retentive surface, capable of movement, advances past a charging station for charging of the charge retentive surface; an exposure station through which the charge retentive surface moves, the charge retentive surface having charged portions being exposed to a scanning device that discharges the charge retentive surface forming a latent image thereon; a development station advances toner particles into contact with the latent image on the charge retentive surface as the charge retentive surface moves through the development station; a transfer station advances a print media for transfer of the toner particles adhered to the latent image onto the print media, the toner particles of the latent image being permanently affixed to the print media via fusing of the latent image of toner particles to the print media; and a cleaning station for removal of the toner particles remaining on the charge retentive surface after transfer, the cleaning station including: a housing having an interior surface wall; and a cleaning brush at least partially enclosed in the housing, the cleaning brush including a core having fibers extending outwardly therefrom, the fibers having a first fiber length and a second fiber length about the core.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 3:
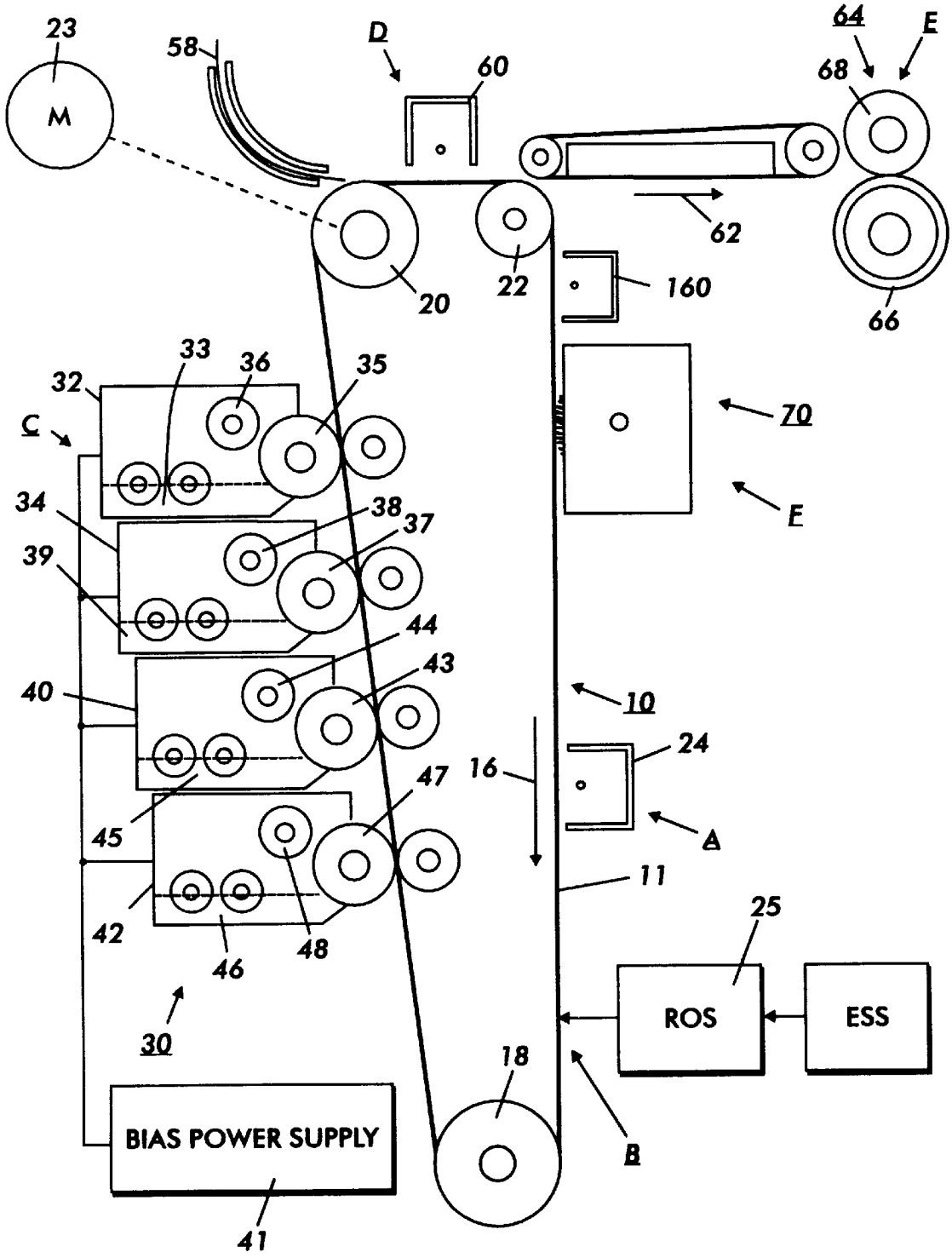
FIG. 3 is a schematic, elevational view of an electrostatographic printing machine incorporating the present invention.

Referring now to the drawings, where the showings are for the purpose of describing a preferred embodiment of the invention and not for limiting same, the various processing stations employed in the reproduction machine illustrated in FIG. 3 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 3, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 than develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer station D from a supply tray, not shown. Sheets are fed from the tray by a sheet feeder, not shown, and advanced to transfer station D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, or other type of cleaning system 70. A preclean corotron 160 is located upstream from the cleaning system 70.

Figure 1:
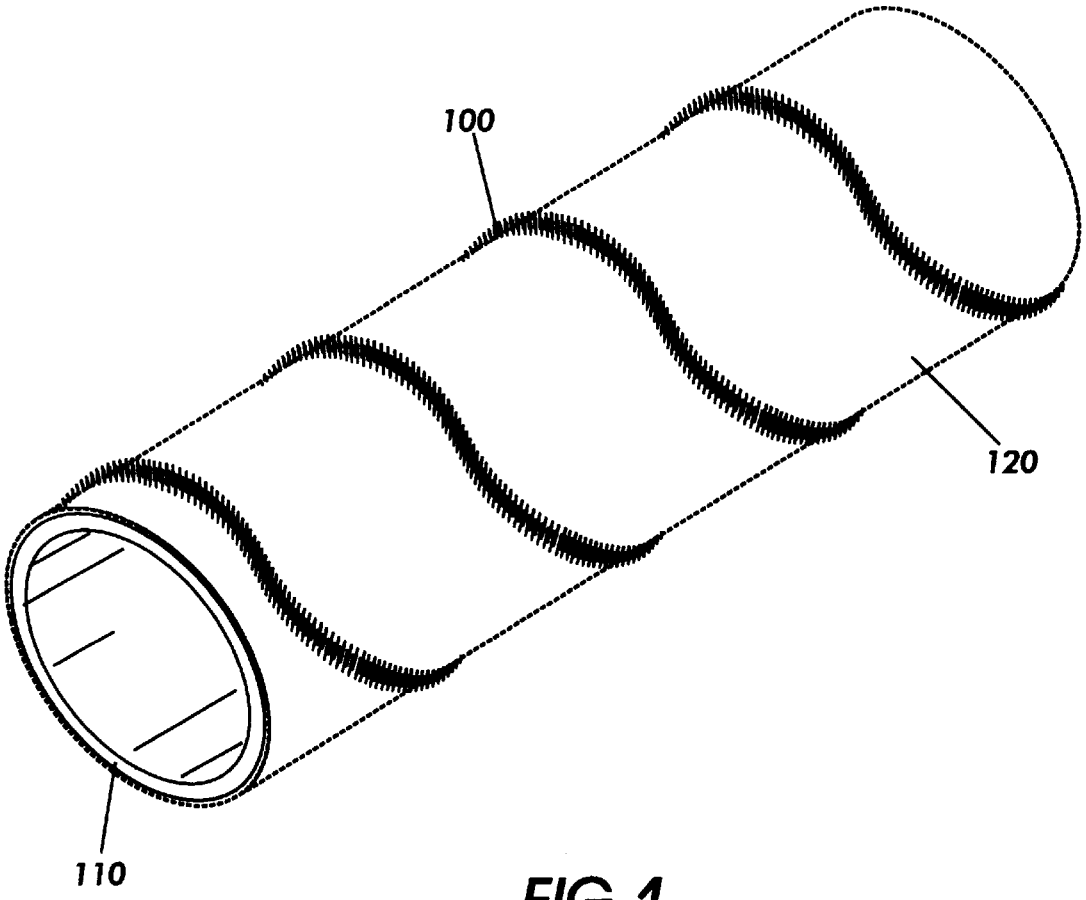
FIG. 1 is an elevational perspective view of the long sweeper fibers along the seam gaps of the fiber material of the cleaner brush extending radially therefrom.

Reference is now made to FIG. 1, which shows a perspective view of an embodiment of the present invention. In this embodiment the brush core 110 shows the long sweeping brush fibers 100, at the seam gaps of the fiber material, extending radially from the brush core. (Note: The remaining shorter fibers radially extending from the brush core are not shown in this figure so that the seam gap long sweeper fibers can clearly be shown. It is also noted that the long sweeping fibers can be in many orientations along the brush (e.g. diagonally, zig-zag, horizontally), not just along the seam gap as shown in FIG. 1). The brush fiber material 120 is spirally wound about the brush core 110. The seam gaps occur where the edges of the fiber material 120 meet in the spiral formation. The long sweeping fibers 100 at the seam gap of an embodiment of the present invention prevent toner droppings from the cleaner by cleaning the housing wall. The remainder of the fibers 140 about the brush core are of shorter length (see FIG. 2) than the fibers at the seam gaps of the fiber material. These shorter length fibers also extend radially from the brush core.

Figure 2:
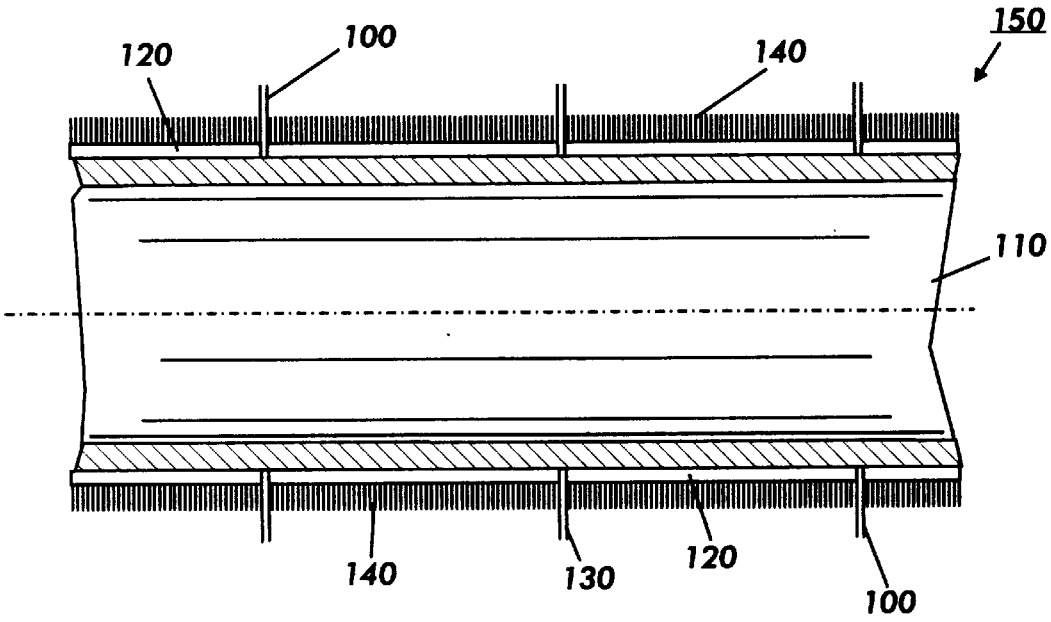
FIG. 2 is a sectional elevational schematic view of the long sweeper fibers and the shorter fibers extending radially from a fiber material about the core of the cleaner brush.

Reference is now made to FIG. 2 which shows a sectional elevational schematic of an embodiment of the present invention including the shorter fibers. In FIG. 2, a material 120 with fibers extending radially therefrom is spirally wound about the brush core 110. The long sweeper fibers 100 are added preferably at the seam gaps 130 on the brush core 110 so that some of the fibers on the brush are longer than others of shorter length 140. The long sweeper fibers 100 sweep against the housing wall (not shown) as the brush 150 rotates, removing toner particles adhering on the interior wall surface of the cleaner housing. These long sweeper fibers 100 are also spirally wound across the brush core so that the wall area can be cleaned and no photoreceptor motion quality disturbances occur due to changes in the brush drag on the photoreceptor. The long sweeper fibers 160 are present along the width of the brush so that the entire housing surface can be swept with the long fibers.

The embodiments of the present invention provides several advantages over an entire brush containing long pile height fibers. First, a long sweeper fiber brush would have much lower photoreceptor drag than a long pile height brush, creating more work for the photoreceptor belt drive. Second, a few long sweeper fibers create less toner emissions than a long pile height brush which contacts the brush housing to prevent toner droppings. Less than approximately 10 percent of the total brush cleaner fibers are made up of the long sweeper fibers. The small increase in toner emissions caused by sweeper fibers flicking off the brush housing is outweighed by the fact that the implementation of this invention eliminates the problem of toner droppings.

In recapitulation, the present invention utilizes long sweeper fibers in conjunction with shorter length fibers about a cleaner brush. The long sweeper fibers continue along the width of the brush. The varying length fibers enable the cleaner brush to remove particles from the imaging surface as well as remove particles that have accumulated along the inner wall of the cleaner housing. The long sweeper fibers remove the particles adhering to the cleaner housing preventing toner droppings onto the photoreceptor into the brush, and into the paper path below the cleaner in products with bottom transfer. Ideally, the inside cleaner housing is cleaned with the fewest possible number of long sweeper fibers. The orientation of the long sweeper fibers is such that only a minimum number of fibers are required to clean across the housing interior.

It is, therefore, apparent that there has been provided in accordance with the present invention, a cleaner brush with long sweeper fibers that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from an imaging surface comprising:

a housing having an interior surface wall; and a cleaning brush at least partially enclosed in said housing, said cleaning brush including a core defining a core length and having first and second fibers extending outwardly therefrom, said first fibers having a first fiber length and said second fibers having a second fiber length shorter than that of said first fiber length, wherein said first fibers are present in an amount of about 10 percent or less of a total of said first and said second fibers and said first fibers present at a seam gap of said core and extending substantially across all of said core length.

2. An apparatus as recited in claim 1, wherein said first fiber length enables frictional interference between said first fiber length of the fibers and the interior surface wall of the housing, said second fiber length, having a shorter length than said first fiber length avoids contact with the interior surface wall of the housing.

3. An apparatus as recited in claim 2, wherein said first fiber length enables removal of the particles adhering to the interior surface wall of said housing.

4. An apparatus as recited in claim 1, wherein said seam gap defines a spiral.

5. An electrostatographic printing machine comprising:

a charge retentive surface, capable of movement, advances past a charging station for charging of said charge retentive surface;

an exposure station through which said charge retentive surface moves, said charge retentive surface having charged portions being exposed to a scanning device that discharges said charge retentive surface forming a latent image thereon;

a development station advances toner particles into contact with the latent image on said charge retentive surface as said charge retentive surface moves through said development station;

a transfer station advances a print media for transfer of the toner particles adhered to the latent image onto the print media, the toner particles of the latent image being permanently affixed to the print media via fusing of the latent image of toner particles to the print media; and a cleaning station for removal of the toner particles remaining on said charge retentive surface after transfer, said cleaning station including: a housing having an interior surface wall; and a cleaning brush at least partially enclosed in said housing, said cleaning brush including a core defining a core length and having first and second fibers extending outwardly therefrom, said first fibers having a first fiber length and said second fibers having a second fiber length shorter than that of said first fiber length, wherein said first fibers are present in an amount of about 10 percent or less of a total of first and second fibers and said first fibers at a seam gap of said core and extending substantially across all of said core length.

6. A printing machine recited in claim 5, wherein said first fiber length enables frictional interference between said first fiber length of the fibers and the interior surface wall of the housing, said second fiber length, having a shorter length than said first fiber length avoids contact with the interior surface wall of the housing.

7. A printing machine as recited in claim 6, wherein said first fiber length enables removal of the particles adhering to the interior surface wall of said housing.

8. A pritting machine as recited in claim 5, wherein said seam gap defines a spiral.

* * * * *